US005860537A

United States Patent [19]

Loew

[11] Patent Number: 5,860,537

[45] Date of Patent: Jan. 19, 1999

[54] DISPLAY UNIT HAVING A DISPLAY ELEMENT AND A STORAGE UNIT INCORPORATING THE SAME

[75] Inventor: Jonathon Loew, East Meadow, N.Y.

[73] Assignee: Design Display Group, Inc., Carlstadt, N.J.

[21] Appl. No.: 760,106

[22] Filed: Dec. 3, 1996

[51] Int. Cl.[6] ..... A47F 1/00

[52] U.S. Cl. ..... 211/104; 40/790; 40/649; 312/138.1; 312/234.3; 16/365; 16/346; 211/134

[58] Field of Search ..... 211/183, 90.01, 211/134, 104, 90.04; 40/574, 790, 791, 649; 108/27, 108; 312/138.1, 234.3, 234.5, 327, 328; 16/366, 365, 346

[56] References Cited

U.S. PATENT DOCUMENTS

| | | | |
|---|---|---|---|
| 1,986,077 | 1/1935 | Spang | 312/114 |
| 2,211,113 | 8/1940 | Hall | 312/138.1 X |
| 3,013,475 | 12/1961 | Spangler | 40/574 |
| 3,776,389 | 12/1973 | Waldecker | 211/90.01 |
| 4,261,122 | 4/1981 | LeVine | 312/204 X |
| 4,433,883 | 2/1984 | Boender et al. | 312/234.3 X |
| 5,042,180 | 8/1991 | Horiuchi | 40/791 |
| 5,269,597 | 12/1993 | Yenglin et al. | 312/138.1 X |
| 5,526,944 | 6/1996 | Merl | 211/104 X |

FOREIGN PATENT DOCUMENTS

| | | | |
|---|---|---|---|
| 1204191 | 11/1965 | Germany | 312/234.3 |
| 679204 | 1/1992 | Switzerland | 211/134 |
| 169821 | 10/1921 | United Kingdom | 16/246 |
| 872764 | 7/1961 | United Kingdom | 312/138.1 |

*Primary Examiner*—Janet M. Wilkens
*Attorney, Agent, or Firm*—Steinberg & Raskin, P.C.

[57] ABSTRACT

A display unit for mounting to a storage unit having a storage space including a frame receivable of a display element and movable between a first position in which access to the storage space is prevented and a lockable second position enabling access to the storage space. The frame is pivotally mounted to the storage unit such that the frame is pivotable about a first pivot axis between the first and second positions. The display unit also includes locking members for locking the frame in the second position.

35 Claims, 6 Drawing Sheets

DISPLAY UNIT HAVING A DISPLAY ELEMENT AND A STORAGE UNIT INCORPORATING THE SAME

FIELD OF THE INVENTION

The present invention relates generally to display devices and, more particularly, to a display unit for mounting to a merchandise storage and sales unit including a frame receivable of a graphics card or display element, and a storage unit incorporating the same. The display unit is designed to cover a storage space in the storage unit when the frame is in an access-preventing position and enable access to the storage space when the frame is in a lockable access-enabling position, e.g., to facilitate the transfer of objects from the storage space to an exposed sales space of the storage and sales unit. The frame is designed to enable easy replacement of the graphics card or display element, e.g., in view of changing merchandise stocked and stored in the storage and sales unit.

BACKGROUND OF THE INVENTION

One common construction for stocking objects such as toys in a retail store is a multi-shelf sales and storage unit wherein the objects to be immediately sold are placed on lower shelves of the unit easily accessible to the purchasing consumers (the sales portion of the unit) and a quantity of the same objects are placed for storage on an upper shelf or shelves immediately above the lower shelves and accessible, e.g., only by means of a ladder or step-stool (the storage portion of the unit). In this manner, the sales staff in the store, upon an indication that the objects on the lower shelves of the unit are depleted or at a reduced level can position the ladder or step-stool to enable access to the upper shelf and transfer the objects from the storage portion maintained on the upper shelf or shelves to the sales portion of the unit. Thereafter, upon receipt of bulk shipments of the objects, it will only be necessary to restock the upper shelf or shelves.

The upper shelf on which the objects are stored is typically not covered, e.g., to enable the sales staff to readily ascertain that the quantity of the objects in storage is at a depleted or reduced level. However, in light of the fact that the upper shelf is uncovered and thus the objects in storage are viewable, a consumer faced with a lack of objects in the sales portion of the unit, i.e., on the lower shelves, will undoubtedly attempt to obtain the object from the storage portion of the unit, i.e., the upper shelf, in the absence of available sales staff to obtain the object for him or her. This may result in the consumer climbing on the unit and possibly damaging the same or causing injury to himself or herself.

OBJECTS AND SUMMARY OF THE INVENTION

It is an object of the present invention to construct a new and improved display unit for retail stores such as toy stores.

It is another object of the present invention to provide a new and improved display unit for use in combination with a storage unit which covers a storage space in the storage unit, e.g., to obstruct viewing of the contents of the storage space, and yet which provides easy and convenient access to the storage space.

It is another object of the present invention to construct a new and improved storage unit including a storage space and a frame including a display element for covering the storage space whereby the frame has a first position preventing access to the storage space and a lockable second position permitting access to the storage space. The storage unit may also include exposed sales spaces in which objects can be displayed for sales.

It is yet another object of the present invention to construct a display unit having a frame receivable of a graphics card or display element and which is constructed to be easily changed when desired, e.g., for promotional sales.

In view of achieving these objects and others, in one embodiment of the device in accordance with the invention, the display unit in accordance with the invention comprises a frame receivable of a graphics card or display element and movable between a first position in which access to a storage space in the storage unit is prevented and a lockable second position enabling access to the storage space and a locking mechanism for locking the frame in the second, access-enabling position. The frame is pivotally mounted to the storage unit by mounting means such as a hinge which enables pivotal movement of the frame about a pivot axis in relation to the storage unit. To this end, the mounting hinge comprises a first member mounted to the storage unit and a second member mounted to the frame, each of the members having a circular portion with a central axis coincident with one another to thereby define the pivot axis of the mounting hinge. The locking means preferably comprise a bracket coupled to the storage unit and a locking hinge comprising a first member coupled to the frame and a second member for pivotally mounting the second member with respect to the first member. Each of the members has a circular portion with a central axis coincident with one another to thereby define a pivot axis. By means of the locking hinge, the second member of the locking hinge is pivotable in relation to the frame into engagement with the bracket coupled to the storage unit to lock the frame in its second, access-enabling position, as well as pivotable out of engagement with the bracket to thereby enable return of the frame to its access-preventing position.

In another embodiment of the display unit in accordance with the invention, the display unit comprises a frame receivable of a display element and mounting means for movably mounting the frame to the storage unit such that the frame is movable between a first position in which access to a storage space in the storage unit is prevented and a second position enabling access to the storage space of the storage unit. The frame comprises at least a first section and a second section defining a periphery of the frame in which a display element is receivable and a panel arranged in the frame. In this embodiment, the first frame section is pivotally mounted by means of a framing hinge to the panel. The pivoting movement of the first frame section in relation to the panel is designed to enable separation of the first frame section from the second frame section and thus facilitate access to the display element and its easy insertion and removal. On the other hand, to prevent the display element from easily falling out of the recess, e.g., during movement of the frame in relation between the first, access-preventing position and the second, access-enabling position, the first frame section and the panel include cooperating locking means for locking the first frame section to the panel. This avoids easy separation of the first frame section from the panel which may lead to release of the display element from the frame. In this embodiment, the display unit may also include the mounting hinge construction described above, as well as the locking hinge construction described above.

The storage unit with a display unit in accordance with the invention comprises at least first and second shelves spaced from one another and defining a storage space therebetween and a frame for retaining the display element and having a first position in which access to the storage space is prevented and a lockable second position enabling access to the storage space. The first shelf is situated above the second shelf and has a gondola section, or another structural member, to which a mounting hinge is attached directly or indirectly. The mounting hinge is also attached to the frame to enable the frame to pivot about a pivot axis in relation to the first shelf between its first, access-preventing position and its second, access-enabling position. To lock the frame in its second, access-enabling position, a locking mechanism is provided and is attached to the frame. In one preferred embodiment, the locking mechanism is the locking hinge construction described above, i.e., a bracket coupled directly or indirectly to the first shelf, and possibly to the gondola section or the portion of the mounting hinge attached to the gondola section, and a first and second members, etc. In this embodiment, the mounting hinge may comprise an elongate planar plate in which case, attachment members attach this planar plate at a plurality of longitudinal locations to the gondola section of the storage unit. Other features of the mounting hinge construction, locking hinge construction and frame described above with respect to the other embodiments of the invention may be used in conjunction with this embodiment. For example, the frame in this embodiment may be as described above, e.g., having at least a first section and a second section defining a periphery of the frame, a panel arranged in the frame and a framing hinge comprising a first member mounted to the first frame section and a second member mounted to the panel.

BRIEF DESCRIPTION OF THE DRAWINGS

A more complete appreciation of the present invention and many of the attendant advantages thereof will be readily understood by reference to the following detailed description of the invention when considered in connection with the accompanying drawings in which.

DETAILED DESCRIPTION OF THE INVENTION

Figure 1:
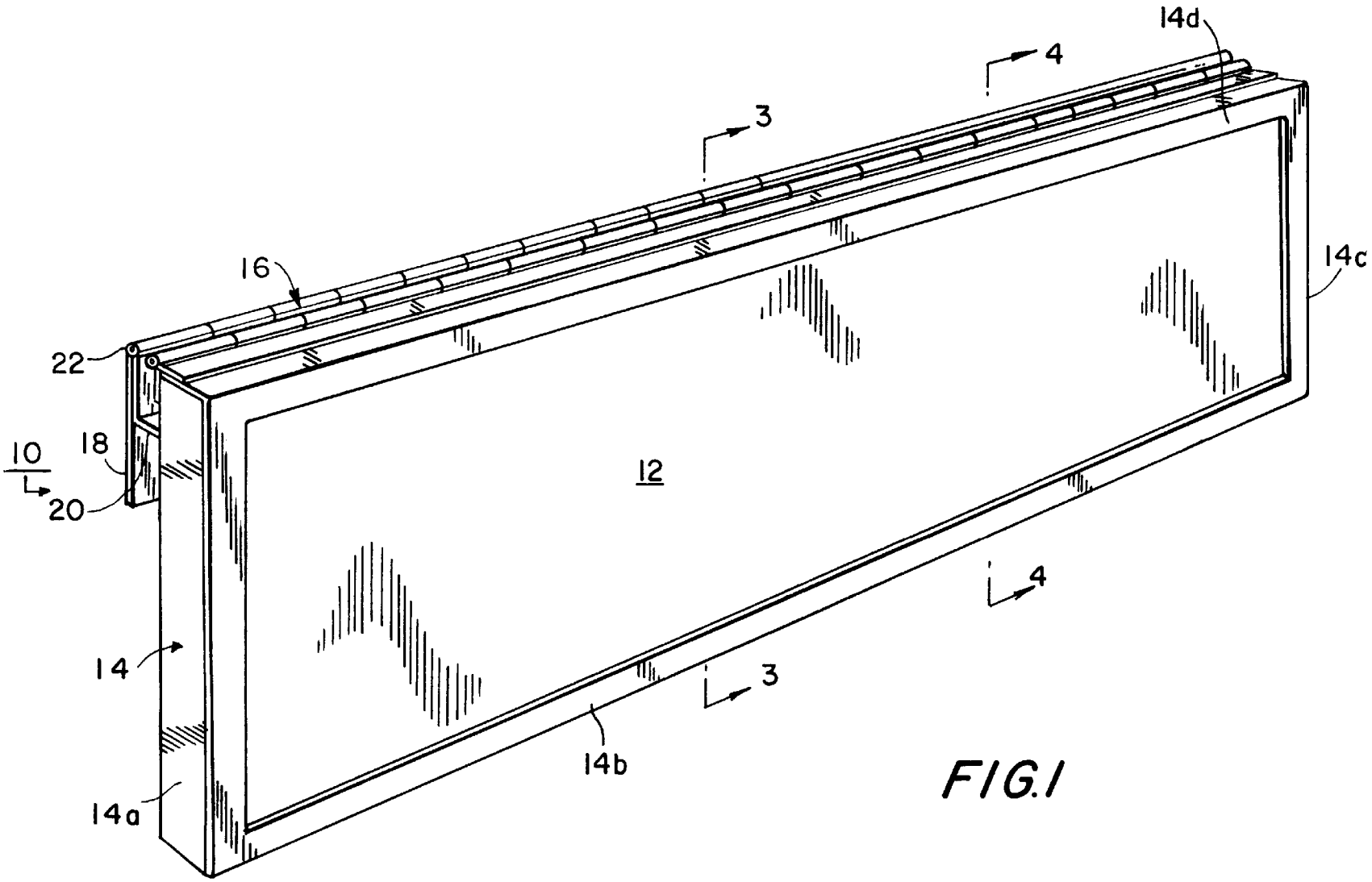
FIG. 1 is a front perspective view of the display unit in accordance with the invention in its access-preventing position.

Referring to the accompanying drawings wherein like reference characters designate identical or corresponding parts throughout the several views, the display unit in accordance with the present invention is designated generally as 10 and is also referred to as a valence assembly. The display unit 10 comprises a rectangular frame 14 surrounding a panel 12 which has dimensions in substantial correspondence with the dimensions of the frame 14. Display unit 10 also includes means 16 for pivotally mounting the frame 14 to a shelf of a storage and sales unit or to another structural member of a storage and sales unit such as a gondola section which is often present in conventional multi-shelf storage and sales unit. One exemplifying embodiment of storage unit incorporating the display unit in accordance with the invention is shown in FIG. 1A and will be described in detail below.

The mounting means 16 comprise two members hingedly connected to one another for relative pivotal movement about a pivot axis 22, namely a substantially planar storage unit mounting bracket 18 attached directly or indirectly to the shelf or structural member of the storage unit and a frame mounting bracket 20 attached directly or indirectly to the frame 14. Each of the brackets 18,20 includes a circular portion having a central axis coincident with one another to thereby define the pivot axis 22. The storage unit mounting bracket 18 is fixed in a stationary position relative to the storage unit such that the frame 14 can be lifted and rotated about the pivot axis 22 with respect to the storage unit. To provide adequate support for the frame 14, the mounting means 16 extend across substantially the entire longitudinal length of the frame 14, i.e., the storage unit mounting bracket 20 and the frame mounting bracket 18 extend across substantially the entire longitudinal length of the frame 14.

Figure 1A:
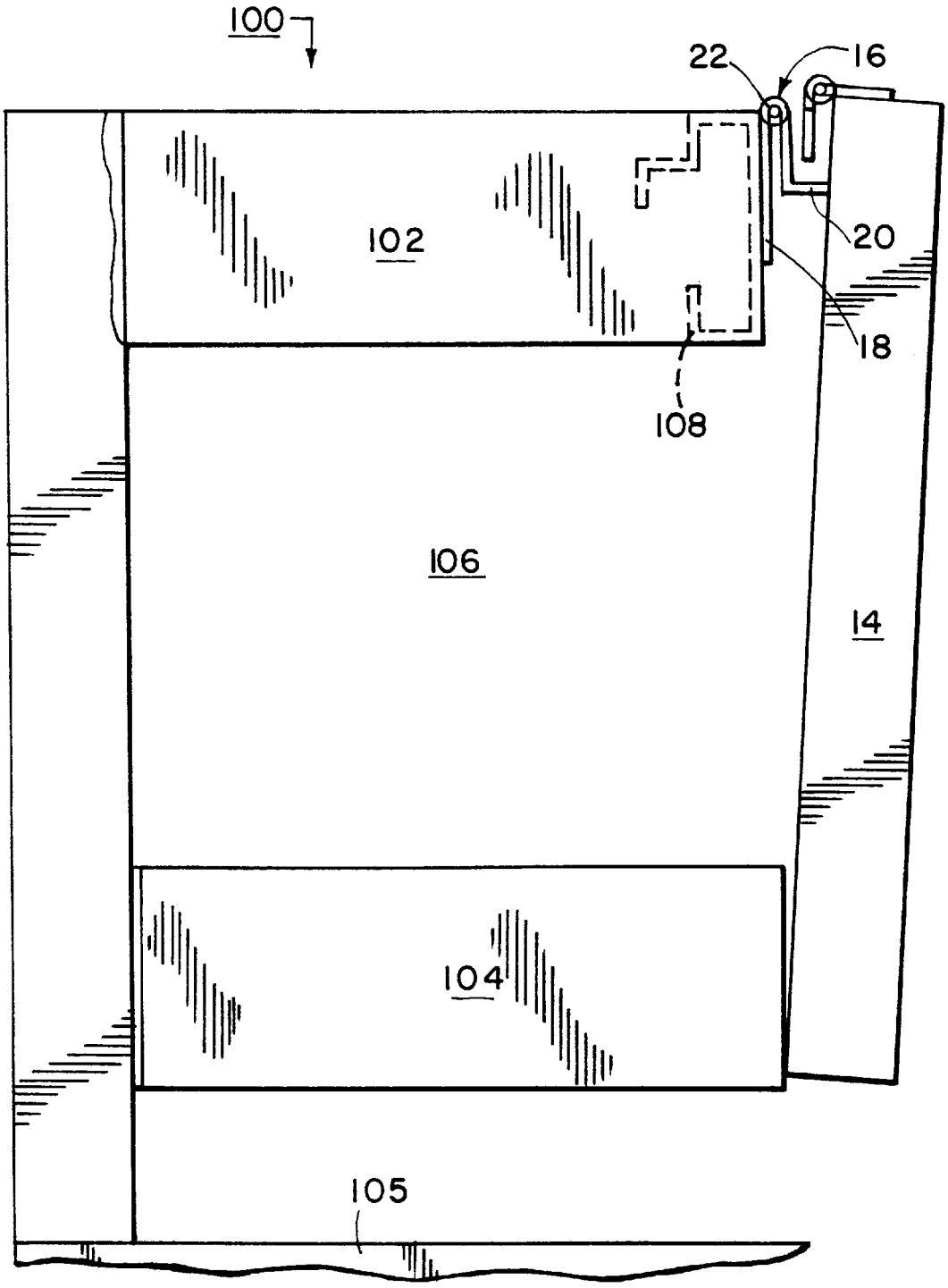
FIG. 1A is a side view of the display unit in accordance with the invention used in conjunction with a multi-shelf sales and storage unit in its access-preventing position.

An exemplifying storage and sales unit which may incorporate the display unit in accordance with the invention is shown in FIG. 1A. The storage and sales unit is designed generally as 100 and comprises a first upper substantially planar shelf 102, a second substantially planar shelf 104 situated below the upper shelf 102 and spaced from the upper shelf 102 to define a storage space 106 therebetween in which objects such as toys can be stored, and the display unit 10 described above. The storage and sales unit 100 may also include at least one additional shelf 105 situated below the second shelf 104 and which defines a sales space to which access to the purchasing consumers is unrestricted. The upper shelf 102 includes a gondola section 108 to which the storage unit mounting bracket 18 is attached by suitable attachment means such as screws, nails, adhesive, welds, etc. The storage and sales unit 100 is designed to selectively enable access to the storage space 106, in view of the pivotable movement of the frame 14 of the display unit 10 via mounting means 16, and the display unit 10 is shown in an access-preventing position in FIG. 1A in which access to the storage space 106 is prevented. Specifically, as shown in FIG. 1A, the frame 14 in its access-preventing hangs down from the upper shelf 102 and extends to a location opposite at least a portion of the lower shelf 104 to rest against the lower shelf 104 so that the panel 12 in the frame 14 completely covers the storage space 106.

Figure 4:
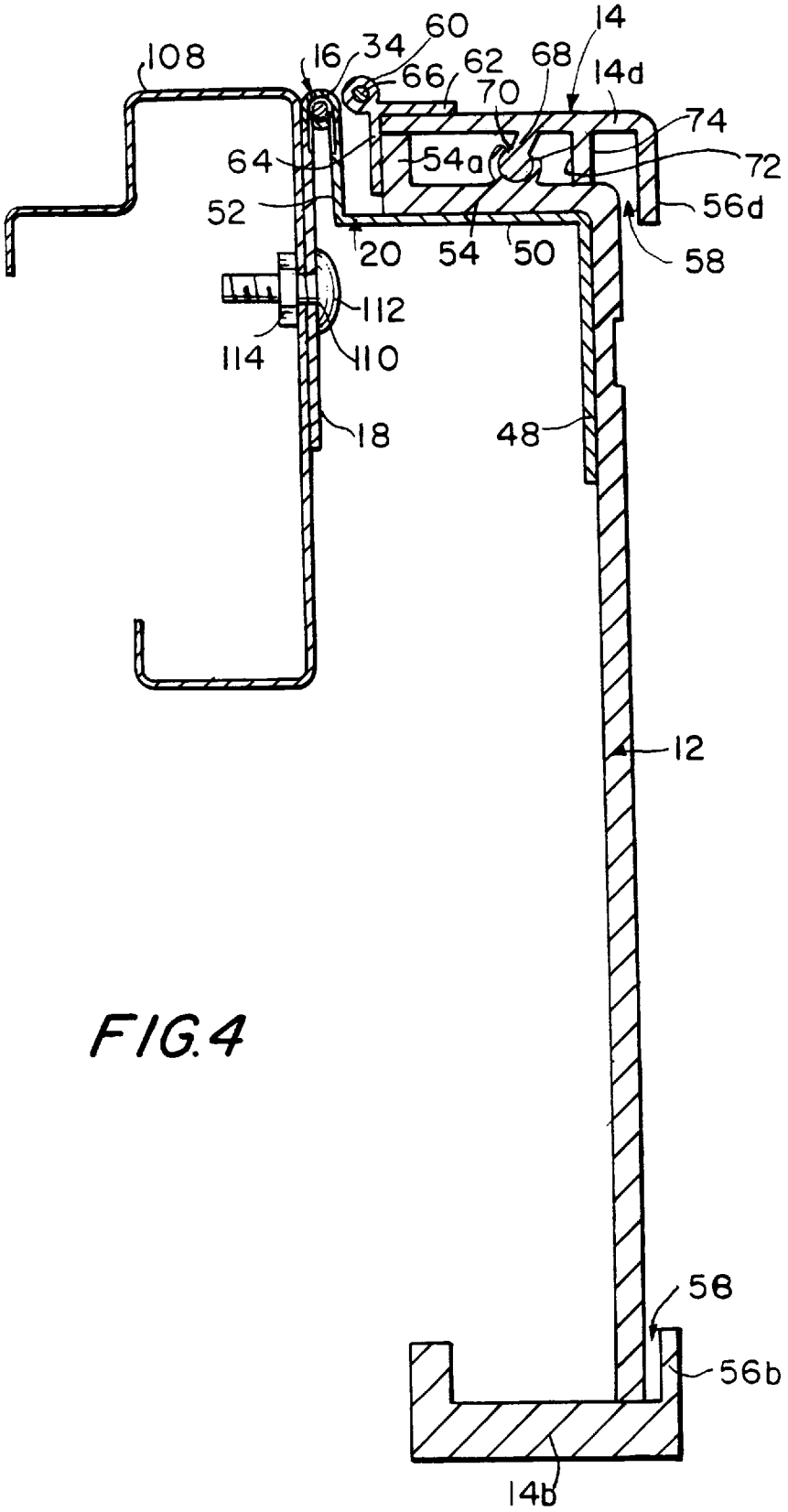
FIG. 4 is a sectional view of the display unit in accordance with the invention taken along line 4—4 of FIG. 1.

In one embodiment, to enable stable attachment of the storage unit mounting bracket 18 to the gondola section 108, and thus the entire frame 14 to the storage and sales unit 100, the storage unit mounting bracket 18 includes plurality of apertures 110 at spaced longitudinal locations and is arranged so that the apertures 110 align with corresponding apertures in the gondola section 108. As shown in FIG. 4, a screw 112 passes through each aligned set of apertures and a nut 114 is threaded onto the screw 112 to enable tightening of the storage unit mounting bracket 18 to the gondola section 108. Other attachment arrangements for attaching the storage unit mounting bracket 18 to the gondola section 108, or more generally for pivotally attaching the frame 14 to the storage and sales unit 100 or the upper shelf 102 thereof are also encompassed within the scope of the invention.

Figure 2:
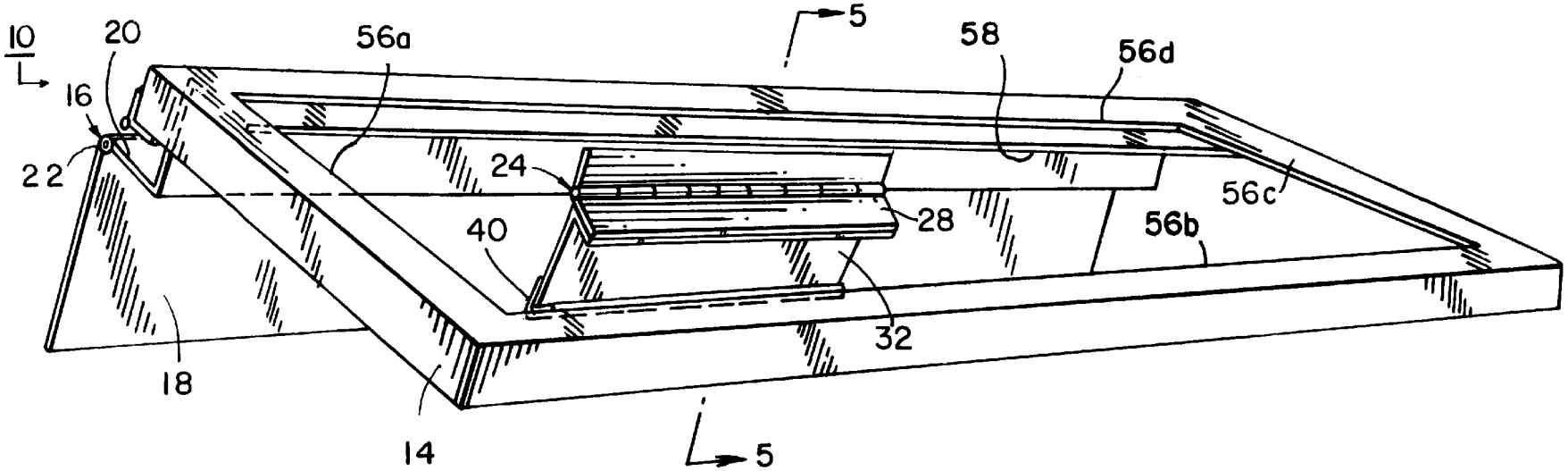
FIG. 2 is a front perspective view of the display unit in accordance with the invention in its access-enabling position.

In operation, when access to the storage space 106 is desired, the display unit 10 is manually raised from its access-preventing position shown in FIG. 1 to its access-enabling position shown in FIG. 2 by lifting the frame 14 to cause the frame 14 and panel 12 retained therein to pivot around the mounting means 16. More particularly, upon lifting of the frame 14, the frame mounting bracket 20 connected to the frame 14 enables a pivotal movement of the frame 14 about pivot axis 22 with respect to the storage unit mounting bracket 18 connected to the storage and sales unit 100.

On the other hand, to maintain the frame 14 in its access-preventing position, and provide some resistance to inadvertent lifting movement to lift the frame 14, biasing means 34 are provided for biasing the frame mounting bracket 20 for pivotal movement toward and in relation to the storage unit mounting bracket 18 (FIG. 4). The biasing means 34 comprise a wound coil having one terminal portion connected to the frame mounting bracket 20 and another opposed terminal portion connected to the storage unit mounting bracket 18.

It will be appreciated by those skilled in the art that the storage and sales unit 100 may include more than two shelves whereby the display unit 10 is positioned in connection with the uppermost shelf only, i.e., to enable unrestricted access to stock items on the lower shelves while maintaining a separate, restricted storage space for those items immediately above the lower shelves. Alternatively, it might be desirable to place a respective display unit to cover a plurality of storage spaces defined between adjacent ones of three or more shelves in a storage and sales unit.

Figure 3:
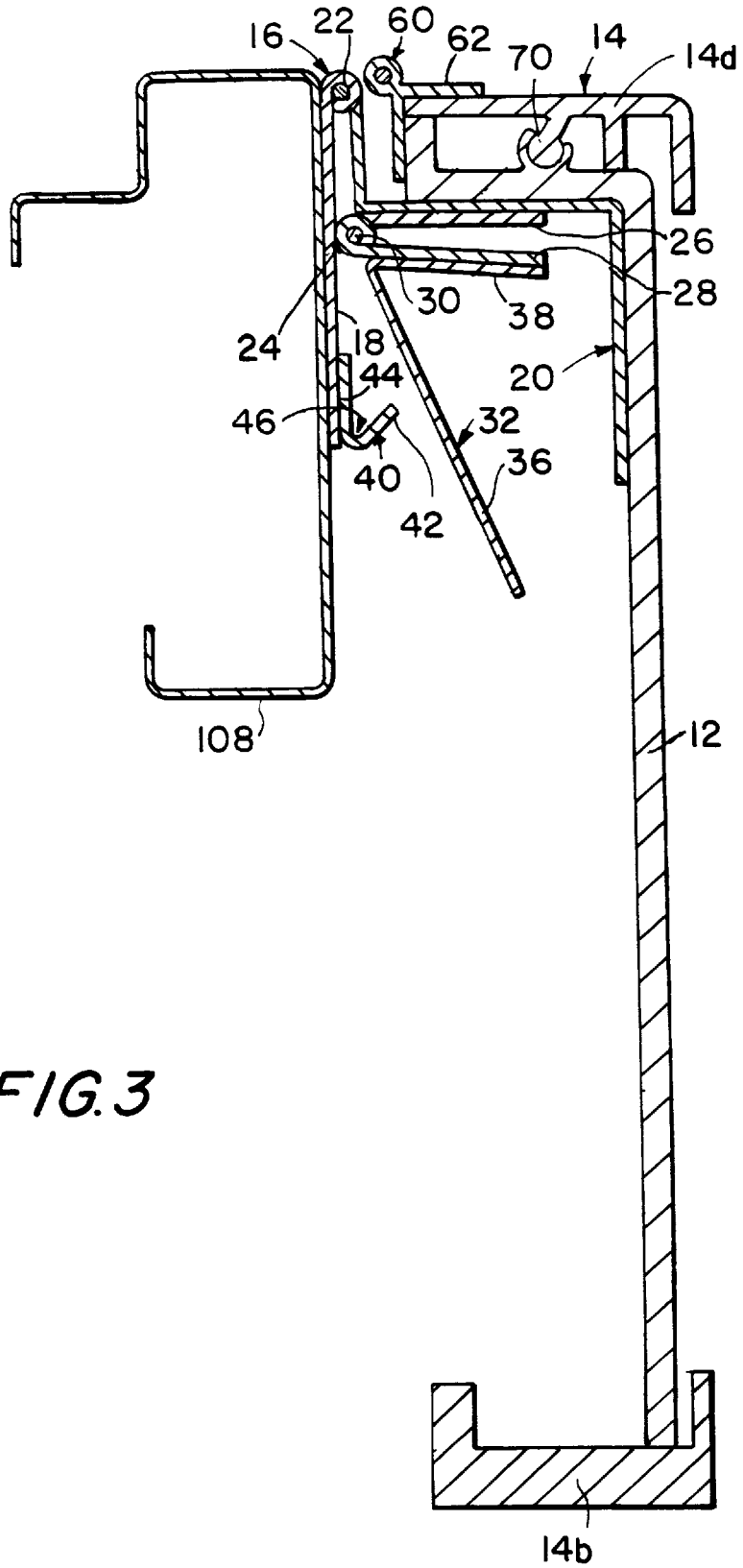
FIG. 3 is a sectional view of the display unit in accordance with the invention taken along line 3—3 of FIG. 1.

When in its access-enabling position as shown in FIG. 2, the frame 14 can be locked by any appropriate locking means to prevent its unintentional return to the access-preventing position. One particularly advantageous embodiment of locking means for use to the display unit in accordance with the invention is shown in FIGS. 2–5. In this embodiment, the locking means for locking the frame 14 in its access-enabling position comprise hinge means 24 including two members hingedly connected to one another for relative pivotal movement about a pivot axis 30, namely a planar member 26 attached directly or indirectly to frame mounting bracket 20 and a planar member 28. Each of the members 26,28 includes a circular portion having a central axis coincident with one another to thereby define the pivot axis 30. Hinge means 24 extend over a portion of the longitudinal length of the frame 14 (FIG. 2). The locking means further include a V-shaped plate 32 having first and second substantially planar portions 36,38 oriented at an angle with respect to one another. Planar portion 38 is fixedly connected to the planar member 28 of the hinge means 24, e.g., by welding. In view of the connection of the plate 32 to the planar member 28, plate 32 is pivotable with respect to the frame 14 about the pivot axis 30 defined in hinge means 24. Lastly, the locking means include an elongate bracket 40 connected to the storage unit mounting bracket 18 as shown in FIG. 3. Bracket 40 is V-shaped having two substantially planar portions 42,44 oriented at an angle with respect to one another to define a groove 46 therebetween. Planar portion 44 is attached directly to the storage unit mounting bracket 20 and planar portion 42 extends outward and upwardly from the planar portion 44.

Upon lifting the frame 14 and pivoting the frame 14 with respect to the storage unit to which it is mounted by mounting means 16, the underside of the frame 14 and the hinge means 24 and plate 32 located thereat are exposed. To effect the locking action, the planar portion 36 of the plate 32 is then positioned in the groove 46 of the bracket 40, e.g., by grasping the joined planar member 28 and planar portion 38 and rotating the same about hinge 30, while the frame is being held up. The planar portion 36 of the plate 32 is then held in the bracket 40 by the outward and upward projecting planar portion 42 (FIG. 5) upon release of the lifting force applied to lift the frame 14. In this position, pivoting of the frame 14 downward about the pivot axis 22 is prevented in view of the interposition of an impediment to the downward movement of the frame 14, i.e., the pivotal movement of the frame 14 about pivot axis 22. To release the locking of the frame 14 in its access-enabling position, the frame 14 is manually lifted up to enable disengagement of the planar portion 36 from the groove 46 in the bracket 40 and while the frame 14 is being held up, the planar portion 36 of the plate 32 is removed from the groove 46 in the bracket 40, e.g., by grasping the joined planar member 28 and planar portion 38 and rotating the same about pivot axis 30 of hinge means 24, and then the frame 14 is lowered. In view of the removal of the planar portion 36 of plate 32 from the groove 46 in the bracket 40, there is no impediment to the downward movement of the frame 14.

Figure 5:
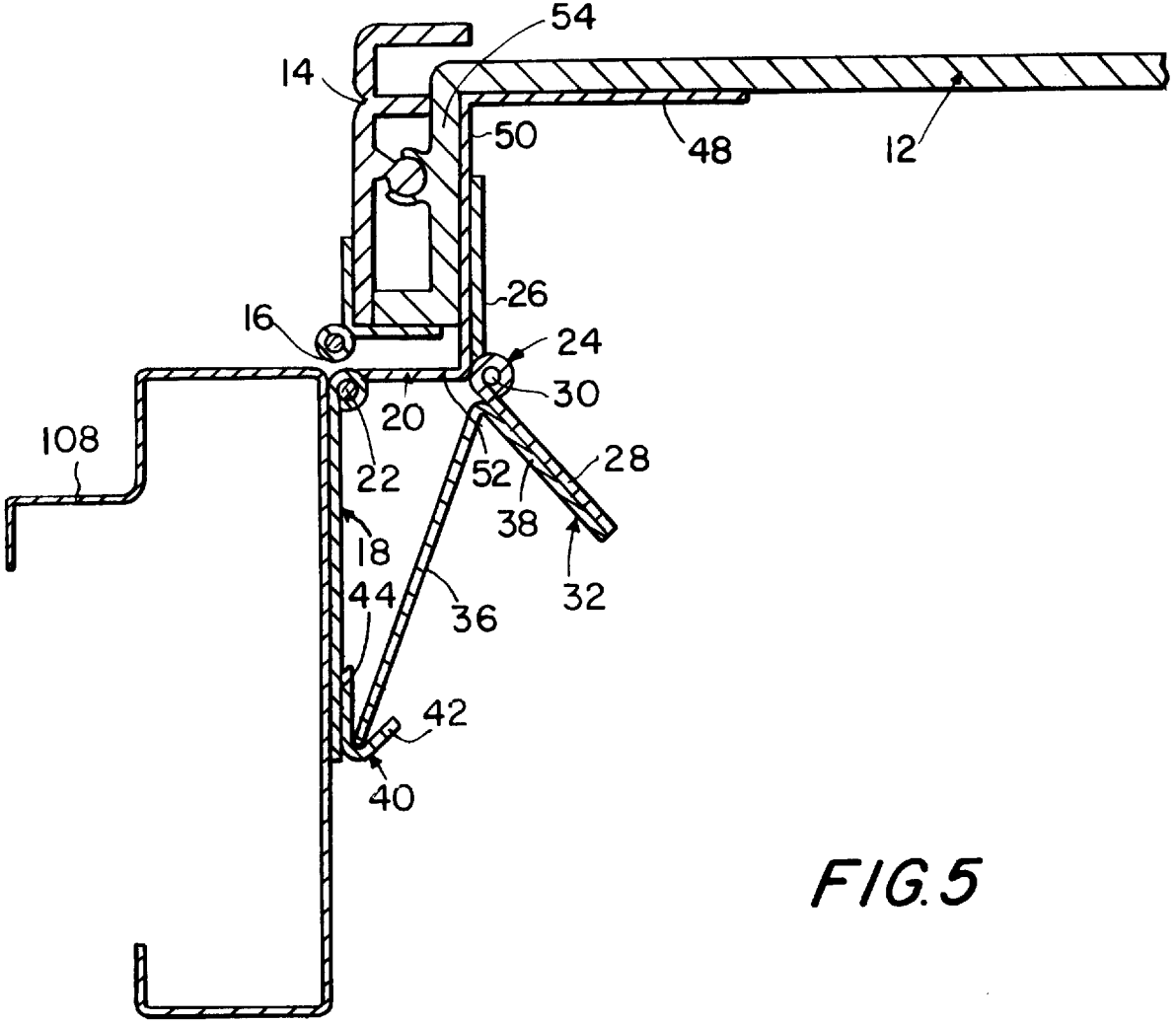
FIG. 5 is a sectional view of the display unit in accordance with the invention taken along line 5—5 of FIG. 2.

With respect to the attachment of the hinge means 16 to the frame 14, the frame mounting bracket 20 comprises an S-shaped member having a first terminal leg portion 52 having a circular portion having a central axis coincident with the pivot axis 22, a second intermediate leg portion 50 and a third terminal leg portion 48. The intermediate leg portion 50 and terminal leg portion 48 are firmly attached to surfaces of the panel 12 so that movement of the frame 14 is adequately transferred to the frame mounting bracket 20. More particularly, terminal leg portion 48 lies flush against a rear surface of the panel 12 and is attached thereto and intermediate leg portion 50 lies flush against a rear face of a flange 54 of the panel 12 extending inward from an upper edge of the panel 12 and is attached thereto (FIGS. 3–5). The panel 12 extends across substantially the entire length of the frame 14 and may be connected to the terminal leg portion 48 and intermediate leg portion 50 of the frame mounting bracket 20 at a plurality of spaced apart locations to provide for a secure connection of the panel 12 to the frame mounting bracket 20. The planar member 26 of the hinge means 24 is attached directly to the intermediate leg portion 50.

The mounting arrangement of the frame 14 to the storage and sales unit can be used for any conventional frame, i.e., to pivotally mount a frame to a storage and sales unit, and similarly, the locking arrangement described above can be used for any conventional frame, i.e., to lock a frame in an access-enabling position. However, one preferred embodiment of a frame for use in connection with the mounting and locking arrangements described above enables a graphics card or display element to be inserted into connection with the frame and securely held therein during movements of the frame to and from its locking position. In this embodiment, the graphics card or display element can be easily removed and replaced to vary the display provided by the display unit 10, as is often required for changing promotional sale specials in toy stores. It is also important to note that this embodiment of the frame can be used independent of the specific mounting arrangement and locking arrangement described above, i.e., it can simply be mounted by a conventional hinge to the storage and sales unit.

In this embodiment, the frame 14 has opposed side sections 14*a*,14*c*, a lower longitudinal section 14*b* joined to the side sections 14*a*, 14*c* at a lower extremity thereof and an opposed upper longitudinal section 14*d* extending between the side sections 14*a*, 14*c* (FIG. 1). The side sections 14*a*,14*c* and lower longitudinal section 14*b* can be manufactured as a single, integral unit from plastic. On the other hand, upper longitudinal section 14*d* is separate from the remaining sections of the frame 14 and is not permanently joined thereto.

The frame sections 14*a*,14*b*,14*c*,14*d* comprise an inwardly directed lip 56*a*,56*b*,56*c*,56*d*, respectively spaced outward from the panel 12 to define a recess 58 around the periphery of the frame 14 in which the graphics card or display element (not shown) is inserted. As shown in FIG. 4, the lower longitudinal frame section 14*b* has an upwardly protruding lip 56*b* to thereby form a lower portion of the recess 58 and similarly, the upper longitudinal frame section 14*d* has a downwardly protruding lip 56*d* at a location beyond the panel 12 to thereby form an upper portion of the recess 58. The side sections 14*a*,14*c* have a similarly constructed lip. The panel 12 will serve as a support for the graphics card or display element.

To facilitate placement and removal of the graphics card or display element, the upper longitudinal frame section 14*d* is pivotally connected to the panel 12 by hinge means 60 which comprise a first substantially planar plate member 62 connected to the upper longitudinal frame section 14*d* and a second substantially planar plate member 64 connected to the panel 12. Planar plate members 62,64 extend across substantially the entire length of the upper longitudinal frame section 14*d* and are pivotable in relation to one another about a pivot axis 66. Each of the plate members 62,64 includes a circular portion having a central axis coincident with one another to thereby define a pivot axis 66 of the hinge means 60. In light of the presence of hinge means 60, the upper longitudinal frame section 14*d* is pivotable from its closed position shown, e.g., in FIG. 3, to an open position enabling access to the graphics card, and removal and/or replacement of the same when desired.

To securely retain the graphics card in the recess 58 and avoid unintentional release of the graphics card from the frame 14, the upper longitudinal frame section 14*d* and panel 12 incorporate a cooperating locking mechanism. The locking mechanism comprises a projection 68 having a cylindrical end portion 70 directed inwardly from the upper longitudinal frame section 14*d* and a cup-shaped extension 72 directed outwardly from the flange 54*a* of the panel 12 and defining an elongate recess. The cup-shaped extension 72 is adapted to receive the cylindrical end portion 70 and retain the same to provide some resistance to the opening of the frame 14. The upper longitudinal frame section 14*d* also includes a longitudinal support rib 74 contacting the flange 54 of the panel 12 in order to provide support for the upper longitudinal frame section 14*d*.

A locking mechanism for locking the upper longitudinal frame section 14*d* to the panel 12 is particularly important if this frame 14 is used in combination with the mounting arrangement described above by means of which the frame is lifted and pivoted. In this case, the graphics card would be securely retained in the frame 14 and would not fall out during movement of the frame 14 between its access-preventing position and its locked access-enabling position.

Depending on its design, the graphics card or display element inserted into the recess 58 in the frame 14 may serve to restrict viewing of the contents of the storage space defined between shelves of the storage and sales unit, if so desired. The graphics card could be a special promotional display, decorative material, or any other sales related or merchandise related display.

The examples provided above are not meant to be exclusive. Many other variations of the present invention would be obvious to those skilled in the art, and are contemplated to be within the scope of the appended claims. As one example, although the illustrated embodiment includes a rectangular frame, any shape frame can be applied in accordance with the teachings of the invention. In the embodiments wherein the frame has at least two separable frame sections to enable access to a display element retain in a recess formed in conjunction with the frame, the frame sections can take any shape on condition that the display element can be inserted and removed from the frame recess upon pivoting of at least one of the frame sections relative to the other. In addition, it is noted that while a hinged mounting means is disclosed for pivotally mounting the frame to the storage unit, other means which provide a pivoting movement between two members are also within the scope of the invention.

I claim:

1. A display unit for mounting to a storage unit having at least one storage space for storing articles intended for sale, comprising:

a frame receivable of a display element and movable between a first position in which access to the storage space and the articles intended for sale when stored in the storage space is prevented and a lockable second position enabling access to the storage space and the articles intended for sale when stored in the storage space, said frame being mountable to the storage unit, first pivotal mounting means for pivotally mounting said frame to the storage unit such that said frame is pivotable about a first pivot axis between said first and second positions, and first locking means for locking said frame in said second position, said frame comprising a first frame section defining at least a portion of a periphery of said frame, a panel and second pivotal mounting means for pivotally mounting said first frame section to said panel, said panel and said first frame section comprising cooperating second locking means for locking said first frame section to said panel.

2. The display unit of claim 1, wherein said first pivotal mounting means comprise a hinge including a first member mountable to the storage unit and a second member mounted to said frame.

3. The display unit of claim 1, wherein said first locking means comprise a bracket coupled to said first pivotal mounting means, and third pivotal mounting means comprising a first member coupled to said frame and a second member, said third pivotal mounting means being structured and arranged to pivotally mount said second member with respect to said first member such that said second member of said third pivotal mounting means is pivotable about a second pivot axis in relation to said frame into engagement with said bracket to lock said frame in said second position.

4. The display unit of claim 3, wherein said third pivotal mounting means comprise a hinge.

5. The display unit of claim 3, wherein said first pivotal mounting means comprise a first member mountable to the storage unit and a second member mounted to said frame and said first member of said third pivotal mounting means is fixedly attached to said second member of said first pivotal mounting means.

6. The display unit of claim 3, wherein said second member of said third pivotal mounting means comprises a first planar plate member having a circular portion having a central axis coincident with said second pivot axis of said third pivotal mounting means and a second substantially V-shaped plate having first and second planar portions joined at an angle, said first planar portion of said V-shaped plate being fixedly attached to said first planar plate member and said second planar portion of said V-shaped plate being engageable with said bracket to lock said frame in said second position.

7. The display unit of claim 3, wherein said first pivotal mounting means comprises a first member mountable to the storage unit and a second member mounted to said frame, said bracket comprising a substantially V-shaped plate having first and second planar portions, said first planar portion being connected to said first member of said first pivotal mounting means and said second planar portion extending outward and upward from said first planar portion to define a groove in which a portion of said second member of said third pivotal mounting means is received.

8. The display unit of claim 3, wherein said second pivotal mounting means comprise a first member mounted to the first frame section and a second member mounted to said panel.

9. The display unit of claim 1, wherein said first pivotal mounting means comprises a first member mountable to the storage unit and a second member mounted to said frame, said first pivotal mounting means comprising biasing means for biasing said second member of said first pivotal mounting means to pivot about said first pivot axis in relation to said first member of said first pivotal mounting means.

10. The display unit of claim 1, wherein said frame further comprises at least a second frame section, each of said first and second frame sections comprising an inwardly directed lip spaced from said panel to thereby define a recess around at least a portion of the periphery of said frame in which the display element is receivable, said second pivotal mounting means comprising a first member mounted to said first frame section and a second member mounted to said panel whereby said first frame section is pivotable in relation to said panel to enable insertion and removal of the display element.

11. The display unit of claim 1, wherein said cooperating second locking means of said first frame section and said panel comprise a projection on said first frame section having a cylindrical end portion and an elongate recess on said panel structured and arranged to receive said cylindrical end portion of said projection on said first frame section.

12. A storage unit including a storage space for storing articles intended for sale and a display unit for restricting access to the storage space of the storage unit, comprising:

means defining at least one shelf constituting the storage space, a frame receivable of a display element, and mounting means for movably mounting said frame to said shelf defining means such that said frame is movable between a first position in which access to the storage space and the articles intended for sale when stored in the storage space is prevented and a second position in which access to the storage space and the articles intended for sale when stored in the storage space is enabled, said frame comprising at least a first frame section and a second frame section defining at least a portion of a periphery of said frame in which the display element is receivable, a panel arranged in said frame, said panel and said first frame section comprising cooperating first locking means for locking said first frame section to said panel, and first pivotal mounting means for pivotally mounting said first frame section to said panel to enable separation of said first frame section from said second frame section to thereby provide access to the display element.

13. The display unit of claim 12, wherein said at least first and second frame sections each comprise an inwardly directed lip spaced from said panel to thereby define a recess around the periphery of said frame in which the display element is receivable.

14. The display unit of claim 12, wherein said cooperating first locking means of said first frame section and said panel comprise a projection on said first frame section having a cylindrical end portion and an elongate recess on said panel structured and arranged to receive said cylindrical end portion of said projection on said first frame section.

15. The display unit of claim 14, wherein said mounting means comprise second pivotal mounting means for pivotally mounting said frame to said shelf defining means such that said frame is pivotable about a first pivot axis between said first position and said second position, said second pivotal mounting means comprising a first member mounted to said shelf defining means and a second member mounted to said frame, further comprising second locking means for locking said frame in said second position, said second locking means comprising a bracket coupled to said second pivotal mounting means, and third pivotal mounting means comprising a first member coupled to said frame and a second member, said third pivotal mounting means being structured and arranged to pivotally mount said second member with respect to said first member such that said second member of said third pivotal mounting means is pivotable about a second pivot axis in relation to said frame into engagement with said bracket to lock said frame in said second position, said first member of said third pivotal mounting means being fixedly attached to said second member of said second pivotal mounting means.

16. The display unit of claim 15, wherein said first member of said second pivotal mounting means comprises an elongate planar plate, further comprising attachment means for attaching said planar plate at a plurality of longitudinal locations to a gondola section of said shelf defining means.

17. The display unit of claim 15, wherein said second member of said third pivotal mounting means comprises a first planar plate member having a circular portion having a central axis coincident with said second pivot axis and a second substantially V-shaped plate having first and second planar portions joined at an angle, said first planar portion of said V-shaped plate being fixedly attached to said first planar plate member and said second planar portion of said V-shaped plate being engageable with said bracket to lock said frame in said second position.

18. The display unit of claim 15, wherein said bracket comprises a substantially V-shaped plate having first and second planar portions, said first planar portion being connected to said first member of said second pivotal mounting means and said second planar portion extending outward and upward from said first planar portion to define a groove in which a portion of said second member of said third pivotal mounting means is receivable.

19. The display unit of claim 15, wherein said second pivotal mounting means comprise biasing means for biasing said second member of said second pivotal mounting means to pivot about said first pivot axis in relation to said first member of said second pivotal mounting means.

20. A storage unit including a display unit for retaining articles intended for sale, comprising at least first and second shelves spaced from one another and defining a storage space therebetween in which the articles intended for sale are retainable, said first shelf being situated above said second shelf, a frame receivable of a display element, first pivotal mounting means for pivotally mounting said frame to said first shelf such that said frame is pivotable about a first pivot axis between a first position in which access to the storage space and the articles intended for sale when retained in the storage space is prevented and a lockable second position enabling access to the storage space and the articles intended for sale when retained in the storage space, and first locking means for locking said frame in said second position, said frame comprising a first frame section defining at least a portion of a periphery of said frame, a panel and second pivotal mounting means for pivotally mounting said first frame section to said panel, said panel and said first frame section comprising cooperating second locking means for locking said first frame section to said panel.

21. The storage unit of claim 20, wherein said first locking means comprise a bracket coupled to said first shelf, and third pivotal mounting means comprising a first member coupled to said frame and a second member, said third pivotal mounting means being structured and arranged to pivotally mount said second member with respect to said first member such that said second member of said third pivotal mounting means is pivotable about a second pivot axis in relation to said frame into engagement with said bracket to lock said frame in said second position.

22. The storage unit of claim 20, wherein said first pivotal mounting means comprise a hinge having a first member mounted to said first shelf and a second member mounted to said frame.

23. The storage unit of claim 22, wherein said first member of said hinge comprises an elongate planar plate and said first shelf comprises a gondola section, further comprising attachment means for attaching said planar plate at a plurality of longitudinal locations to said gondola section of said first shelf.

24. The storage unit of claim 20, wherein said first frame section is pivotally mounted to said panel such that said first frame section is pivotable in relation to said panel to enable insertion and removal of the display element.

25. A display unit for mounting to a storage unit having at least one storage space, comprising:

a frame receivable of a display element and movable between a first position in which access to the storage space is prevented and a lockable second position enabling access to the storage space, said frame being mountable to the storage unit, first pivotal mounting means for pivotally mounting said frame to the storage unit such that said frame is pivotable about a first pivot axis between said first and second positions, and locking means for locking said frame in said second position, said locking means comprising a bracket coupled to said first pivotal mounting means, and second pivotal mounting means comprising a first member coupled to said frame and a second member, said second pivotal mounting means being structured and arranged to pivotally mount said second member with respect to said first member such that said second member of said second pivotal mounting means is pivotable about a second pivot axis in relation to said frame into engagement with said bracket to lock said frame in said second position, said second member of said second pivotal mounting means comprising a first planar plate member having a circular portion having a central axis coincident with said second pivot axis of said second pivotal mounting means and a second substantially V-shaped plate having first and second planar portions joined at an angle, said first planar portion of said V-shaped plate being fixedly attached to said first planar plate member and said second planar portion of said V-shaped plate being engageable with said bracket to lock said frame in said second position.

26. A display unit for mounting to a storage unit having at least one storage space, comprising:

a frame receivable of a display element and movable between a first position in which access to the storage space is prevented and a lockable second position enabling access to the storage space, said frame being mountable to the storage unit, first pivotal mounting means for pivotally mounting said frame to the storage unit such that said frame is pivotable about a first pivot axis between said first and second positions, said first pivotal mounting means comprising a first member mountable to the storage unit and a second member mounted to said frame, and locking means for locking said frame in said second position, said locking means comprising a bracket coupled to said first pivotal mounting means, and second pivotal mounting means comprising a first member coupled to said frame and a second member, said second pivotal mounting means being structured and arranged to pivotally mount said second member with respect to said first member such that said second member of said second pivotal mounting means is pivotable about a second pivot axis in relation to said frame into engagement with said bracket to lock said frame in said second position, said bracket comprising a substantially V-shaped plate having first and second planar portions, said first planar portion being connected to said first member of said first pivotal mounting means and said second planar portion extending outward and upward from said first planar portion to define a groove in which a portion of said second member of said second pivotal mounting means is received.

27. A display unit for mounting to a storage unit having at least one storage space, comprising:

a frame receivable of a display element and movable between a first position in which access to the storage space is prevented and a lockable second position enabling access to the storage space, said frame being mountable to the storage unit, first pivotal mounting means for pivotally mounting said frame to the storage unit such that said frame is pivotable about a first pivot axis between said first and second positions, and locking means for locking said frame in said second position, said frame comprising at least a first section and a second section defining at least a portion of a periphery of said frame, a panel arranged in said frame and second pivotal mounting means for pivotally mounting said first frame section to said panel, said panel and said first frame section comprising cooperating locking means for locking said first frame section to said panel.

28. The display unit of claim 27, wherein said cooperating locking means of said first frame section and said panel comprise a projection on said first frame section having a cylindrical end portion and an elongate recess on said panel structured and arranged to receive said cylindrical end portion of said projection on said first frame section.

29. A storage unit including a storage space and a display unit for restricting access to the storage space of the storage unit, comprising:

means defining at least one shelf constituting the storage space, a frame receivable of a display element, and mounting means for movably mounting said frame to said shelf defining means such that said frame is movable between a first position in which access to the storage space is prevented and a second position enabling access to the storage space, said frame comprising at least a first frame section and a second frame section defining at least a portion of a periphery of said frame in which the display element is receivable, a panel arranged in said frame, and first pivotal mounting means for pivotally mounting said first frame section to said panel to enable separation of said first frame section from said second frame section to thereby provide access to the display element, said panel and said first frame section comprising cooperating locking means for locking said first frame section to said panel.

30. The display unit of claim 29, wherein said cooperating locking means of said first frame section and said panel comprise a projection on said first frame section having a cylindrical end portion and an elongate recess on said panel structured and arranged to receive said cylindrical end portion of said projection on said first frame section.

31. The display unit of claim 30, wherein said mounting means comprise second pivotal mounting means for pivotally mounting said frame to said shelf defining means such that said frame is pivotable about a first pivot axis between said first position and said second position, said second pivotal mounting means comprising a first member mounted to said shelf defining means and a second member mounted to said frame, and locking means for locking said frame in said second position, said locking means comprising a bracket coupled to said shelf defining means, and third pivotal mounting means comprising a first member coupled to said frame and a second member, said third pivotal mounting means being structured and arranged to pivotally mount said second member with respect to said first member such that said second member of said third pivotal mounting means is pivotable about a second pivot axis in relation to said frame into engagement with said bracket to lock said frame in said second position, said first member of said third pivotal mounting means being fixedly attached to said second member of said second pivotal mounting means.

32. The display unit of claim 31, wherein said first member of said second pivotal mounting means comprises an elongate planar plate, further comprising attachment means for attaching said planar plate at a plurality of longitudinal locations to a gondola section of said shelf defining means.

33. The display unit of claim 31, wherein said second member of said third pivotal mounting means comprises a first planar plate member having a circular portion having a central axis coincident with said second pivot axis and a second substantially V-shaped plate having first and second planar portions joined at an angle, said first planar portion of said V-shaped plate being fixedly attached to said first planar plate member and said second planar portion of said V-shaped plate being engageable with said bracket to lock said frame in said second position.

34. The display unit of claim 31, wherein said bracket comprises a substantially V-shaped plate having first and second planar portions, said first planar portion being connected to said first member of said second pivotal mounting means and said second planar portion extending outward and upward from said first planar portion to define a groove in which a portion of said second member of said third pivotal mounting means is receivable.

35. The display unit of claim 31, wherein said second pivotal mounting means comprise biasing means for biasing said second member of said second pivotal mounting means to pivot about said first pivot axis in relation to said first member of said second pivotal mounting means.

* * * * *